United States Patent [19]

Matsuo

[11] Patent Number: 4,651,850

[45] Date of Patent: Mar. 24, 1987

[54] ACOUSTIC LENS

[75] Inventor: Koji Matsuo, Tokyo, Japan

[73] Assignee: Matsushita Electric Industrial Co., Ltd., Kadoma, Japan

[21] Appl. No.: 834,105

[22] Filed: Feb. 24, 1986

Related U.S. Application Data

[63] Continuation of Ser. No. 503,304, Jun. 10, 1983, abandoned.

[30] Foreign Application Priority Data

Jun. 10, 1982 [JP] Japan ..... 57-100202

[51] Int. Cl.[4] ..... G10K 11/00

[52] U.S. Cl. ..... 181/176; 181/175

[58] Field of Search ..... 181/167, 168, 176, 294, 181/175; 381/91; 428/338, 447; 350/354; 524/497, 588

[56] References Cited

U.S. PATENT DOCUMENTS

| | | | |
|---|---|---|---|
| 2,985,613 | 5/1961 | Campbell | 524/497 |
| 3,616,184 | 10/1971 | Katagiri et al. | 524/497 |
| 3,907,581 | 9/1975 | Willcox | 524/497 X |
| 4,310,444 | 1/1982 | Hamada et al. | 524/588 X |

*Primary Examiner*—Benjamin R. Fuller

*Attorney, Agent, or Firm*—Cushman, Darby & Cushman

[57] ABSTRACT

An acoustic lens for use in an ultrasonographic probe is made of a material including silicone rubber mixed with particles of titanium oxide having diameters ranging from 0.08 to 0.20 μm. The particles are mixed at a ratio in the range of 30 to 65 wt %.

3 Claims, 8 Drawing Figures

ACOUSTIC LENS

This is a continuation of application Ser. No. 503,304, filed June 10, 1983, which was abandoned upon the filing hereof.

BACKGROUND OF THE INVENTION

The present invention relates to an acoustic lens for converging a beam of acoustic energy such as ultrasonic waves transmitted from an ultrasonographic probe used for visualizing deep structures of human bodies.

Various acoustic lenses are known for use in ultrasonographic probes. However, no satisfactory acoustic lenses have been proposed for use in trapezoidal scanning ultrasonographic probes.

SUMMARY OF THE INVENTION

It is an object of the present invention to provide an acoustic lens suitable for use in a trapezoidal scanning ultrasonographic probe.

According to the present invention, an acoustic lens is made of silicone rubber mixed with particles having diameters ranging from 0.08 to 0.20 μm. The particles are mixed in the range of 30 to 65 wt %, and are of titanium oxide.

BRIEF DESCRIPTION OF THE DRAWINGS

The present invention will be described in detail by way of illustrative example with reference to the accompanying drawings, in which.

DETAILED DESCRIPTION

Figure 1:
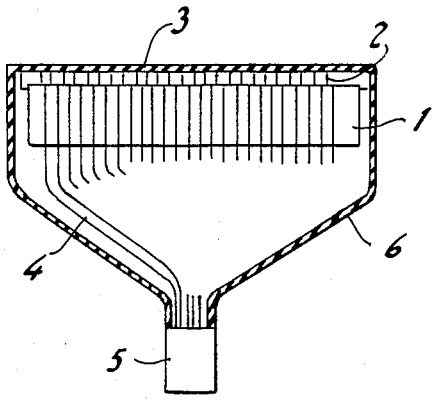
FIG. 1 is a cross-sectional view of an ultrasonographic probe, the view being taken along an array of electroacoustic transducer elements.

FIG. 1 shows an ultrasonographic probe now in general use. The ultrasonographic probe comprises an array of electroacoustic transducer elements 2 such as piezoelectric vibrators mounted on a holder 1, and an acoustic lens 3 disposed on the array of electroacoustic transducer elements 2 for contact with a living body. The electroacoustic transducer elements 2 are connected to lead wires 4 for being supplied with a drive pulse signal and delivering a reception pulse signal, the lead wires 4 being coupled to a cable 5 for connection with an external ultrasonographic unit. The probe is contained in a case 6 with the acoustic lens 3 exposed for contact with a human body to be examined.

Figure 2:
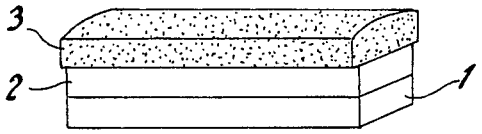
FIG. 2 is a perspective view of an electroacoustic transducer in the ultrasonographic probe.

In FIG. 2, the acoustic lens 3 mounted on the array of transducer elements 2 has a convex round outer surface remote from the holder 1 on which the transducer elements 2 are supported.

Figure 3:
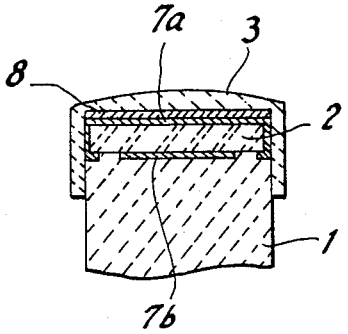
FIG. 3 is a cross-sectional view of the ultrasonographic probe, taken along a line perpendicular to the array of electroacoustic transducer elements.

As shown in FIG. 3, the electroacoustic transducer elements 2 include a pair of electrodes *7a, 7b,* the electrode *7a* being disposed below the acoustic lens 3 and the electrode *7b* being placed on the holder 1. An acoustic matching layer 8 is placed on the array of electroacoustic transducer elements 2 above the electrode *7a,* the acoustic matching layer 8 having a thickness on the order of a few hundred corresponding to a quarter of a wavelength of ultrasonic waves transmitted from the electroacoustic transducer elements 2. The acoustic lens 3 mounted on the acoustic matching layer 8 for converging a beam of ultrasonic energy emitted from the transducer elements 2. The acoustic lens 3 is made of silicone rubber. The round outer surface of the acoustic lens 3 is substantially arcuate in a direction perpendicular to the array of electroacoustic transducer elements 2, such that the acoustic lens 3 has a thickness maximum at its center and progressively smaller toward its lateral edges. The arcuately round outer surface of the acoustic lens 3 is capable of smoothly and intimately contacting a living body. In use, a paste-like material is normally placed between the acoustic lens and a living body to be inspected. The arcuately round outer surface of the acoustic lens allows any unwanted air bubbles causing much acoustic attenuation to be removed from the paste-like material.

Acoustic lenses are generally expected to meet the following requirements: 1. They should converge or focus a beam of ultrasonic waves transmitted; 2. No air layer is to be formed between the acoustic lens and the examinee's body; 3. Reflection of ultrasonic waves should be minimized at the interference between the acoustic lens and the body to prevent ultrasonic waves from being disturbed in the body; and 4. The acoustic lens should cause as small acoustic attenuation as possible in order to satisfy the above three requirements.

The requirement 2 can be met by the round outer surface of the acoustic lens. To meet the requirement 1, the ultrasonic beam should travel through the acoustic lens at a speed smaller than that in living bodies, especially in human living bodies in which ultrasonic waves run at a sound velocity of 1.5 km/s. A material that meets such a velocity requirement is silicone rubber, which has been in general use.

The requirement 3 will be described in detail. Let the acoustic impedances of the transducer elements 2, the acoustic lens 3, and the living body be expressed by $Z_0$, $Z_1$, $Z_2$, respectively. Since $Z_0 >> Z_2$ generally, various interferences cause ultrasonic reflections even if the acoustic impedance $Z_1$ of the acoustic lens 3 is varied. As shown in FIG. 3, the acoustic lens 3 has a curved surface serving as an interference with the living body, and the interference between the transducer elements 2 and the acoustic lens 3 is flat. Though the flat interference allows ultrasonic waves to pass and reflect in a constant direction, the curved surface of the acoustic lens causes ultrasonic waves to pass and reflect in different directions, thus disturbing ultrasonic waves to a large extent. The acoustic impedance of living bodies, particularly human bodies, generally ranges from 1.4 to $1.6\times10^5$ (g/cm$^2$.s) dependent on locations on the body where it is measured. Where the acoustic lens 3 is made of silicone rubber, its acoustic impedance $Z_1$ can be expressed by:

$$Z_1=\rho\times V1 \text{ (g/cm}^2\text{·s)}$$

where $\rho$: density (g/cm$^3$) of the lens, and V1: sound velocity (cm/s). By changing materials mixed with the silicone material, the acoustic impedance $Z_1$ can vary in the range of from 1.0 to $1.5\times10^5$ (g/cm$^2$·s). It has been a conventional practice to employ a silicone rubber having an acoustic impedance of $1.4-1.6\times10^5$ (g/cm$^2$·s) and a composition selected to provide matching between the acoustic impedances of the acoustic lens and the human body for thereby substantially eliminating ultrasonic reflections in the interference, as disclosed in Japanese Laid-Open Patent Publication No. 51-51181.

With the presently available silicone rubber composition having an acoustic impedance of about $1.4\times10^5$ (g/cm$^2$·s) and tending to attenuate ultrasonic waves passing therethrough, acoustic attenuation is in the range of from 2.3 to 2.8 dB/mm at an ultrasonic frequency of 3.5 MHz. The acoustic lens having the configuration as shown in FIGS. 1 through 3, with a central thickness of slightly less than 1 mm, causes an attenuation of about 5 dB as the ultrasonic beam travels back and forth therethrough. The acoustic lens 3, which is of a linear scanning type, causes an acoustic attenuation of a few dB with the electroacoustic transducer elements 2 arrayed in one direction on the holder 1, but can be used in practice.

Figure 4:
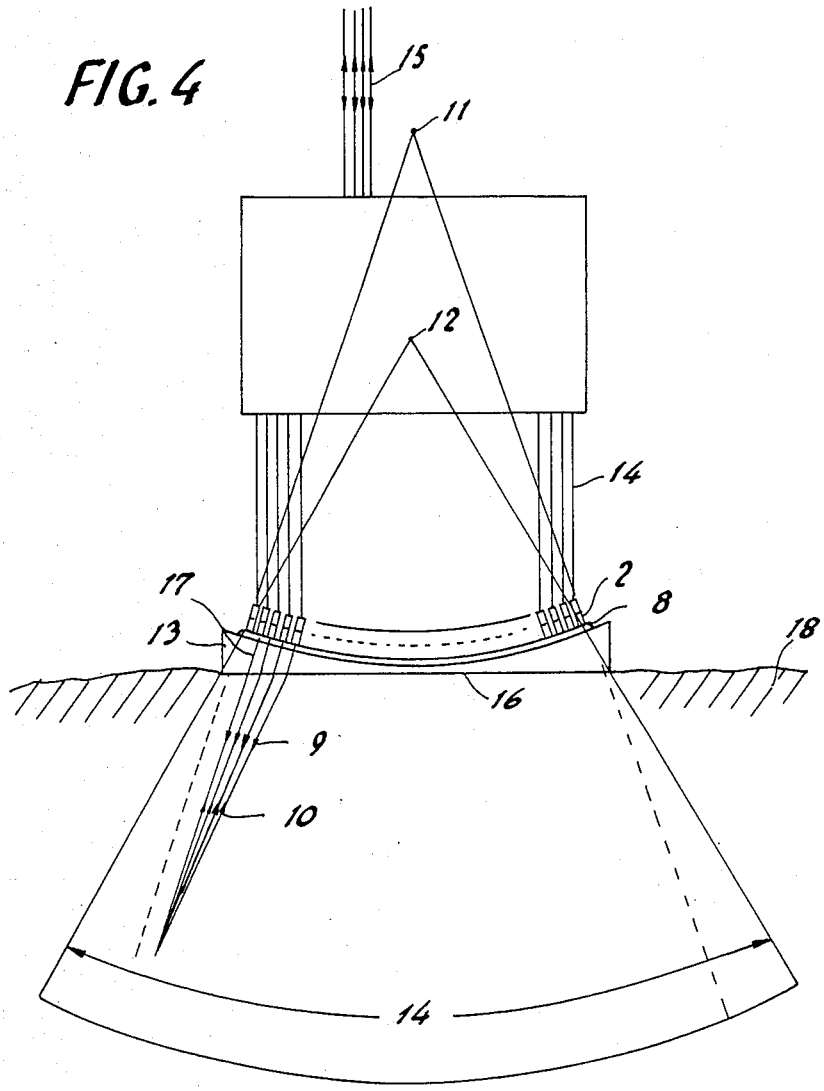
FIG. 4 is a schematic front elevational view of a trapezoidal scanning probe.

FIG. 4 illustrates a trapezoidal scanning ultrasonic probe capable of providing a larger inspection zone through a small area of contact with a human body being examined. The probe has a curved array of electroacoustic transducer elements 2, an acoustic matching layer 8, and an acoustic lens 13 having a concave surface on which the curved array of electroacoustic transducer elements 2 is mounted and a flat surface for contact with a living body 18. The acoustic lens 13 of such a configuration increases a scanning angle of ultrasonic energy, that is, provides a greater inspection zone. An ultrasonic beam transmitted from the electroacoustic transducer elements 2 is deflected by the acoustic lens 13, goes along the directions of the arrows 9 through the body 18, is reflected by a tissue in the body 18 and travels back as a reflected wave 10, which is received by the transducer elements 2 and transmitted through a cable 15 to a display unit. The zone scanned in the body 18 by the ultrasonic signal from the probe is of a sectorial shape 14 having an arc extending around a central point 12. The central point 12 is positioned more closely to the acoustic lens 13 than is a point 11 around which the curved array of transducer elements 2 extends, a condition which increases the ultrasonic scanning angle.

The concave surface of the acoustic lens 13 extends in the direction in which the transducer elements 2 are arrayed. The acoustic lens 13 provides an ultrasonic wave path of a length of about 7 mm at an end, and an ultrasonic wave path of a length of about 1 mm at a center. As an ultrasonic beam of a frequency of 3.5 MHz passes back and forth through the acoustic lens 3, the latter causes an attenuation of 35 dB at its end and an attenuation of 5 dB at its center. The acoustic lens 13 is therefore disadvantageous in that its ultrasonic attenuation at the ends 17 is large, and the difference between attenuations at the ends 17 and the center 16 is large. Any sensitivity difference due to the different attenuation degrees at the ends 17 and the center 16 is reduced only by 10 dB by changing the transducer drive voltage when the ultrasonic beam passes through the ends 17 and the center 16. The acoustic lens 13 has to be made of a material which causes an attenuation of 0.8 dB/mm or smaller at an ultrasonic frequency of use.

Figure 5:
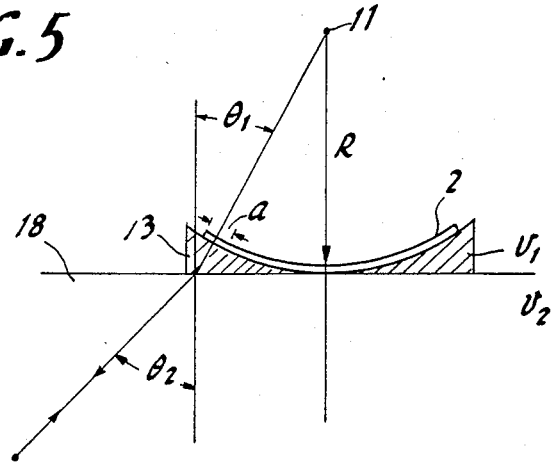
FIG. 5 is a cross-sectional view of an acoustic lens in the scanning probe shown in FIG. 4.

It is preferable that the difference between the ultrasonic wave paths across the ends 17 and the center 16 be as small as possible. FIG. 5 shows the relationships between an effective visual range $\theta_2$ of the trapezoidal scanning probe, a radius R of curvature of the concave surface of the acoustic lens 13, and a sound velocity V1 through the acoustic lens 13. Assuming that the array of electroacoustic transducer elements 2 has a length l and the sound velocity through the body 18 being inspected is V2, with the length and the sound velocity being constant, the following relationship is established:

$$R \approx (l/2)/\sin^{-1}(C\cdot V1)$$

When the second velocity V1 through the acoustic lens 13 changes from 1 km/s to 0.8 km/s with the effective visual range $\theta_2$ remaining to be 30°, the radius R of curvature of the acoustic lens 13 is increased and the difference between the ultrasonic wave paths at the ends 17 and the center 16 is reduced from 6 mm to 3.7 mm. Where a reduction in the attenuation difference between the ends 17 and the center 16 is achieved by 10 dB through changing the transducer drive voltage, the acoustic lens should be made of a material which causes an attenuation of 1.40 dB/mm or less at a frequency of use.

Any commercially available silicone rubbers for use as acoustic lenses however fails to meet the desired acoustic attenuation and sound velocity. For example, known silicone rubbers include those which have an acoustic attenuation $\alpha=2.7$ dB/mm with an acoustic impedance $Z_1=1.45$ g/cm$^2$·s, those of $\alpha=2.3$dB/mm with $Z_1=1.5$ g/cm$^2$·s, and those of $\alpha=2.3$ dB/mm with $Z_1=1.38$ g/cm$^2$·s. Therefore, the acoustic attenuation $\alpha$ is about 2.5 dB/mm which is approximately twice the desired level. The known silicone rubbers are not suitable for use as trapezoidal acoustic lenses.

Briefly summarized, acoustic lenses having a thickness that varies in the scanning direction for use in trapezoidal scanning ultrasonographic probes are required to have a sound velocity V1 therethrough of 1 km/s or less, an acoustic attenuation $\alpha$ of 1.4 dB/mm or smaller, and an acoustic impedance $Z_1$ ranging from 1.4 to $1.6\times10^5$ g/cm$^2$·s. No conventional acoustic lenses can meet such requirements and are suited for use in trapezoidal scanning ultrasonographic probes.

The present invention will be described with reference to FIGS. 6 through 8.

Silicone rubbers characterized by a sound velocity of 1 km/s or less are suitable for use as a material for acoustic lenses. The silicone rubber is stable, harmless to human skins, resilient, pliable, and lends itself to mass production. To meet the optimum performance of acoustic lenses, that is, the requirements of a sound velocity V1 of about 0.8 km/s, an acoustic attenuation $\alpha$ of 1.0 dB/mm or smaller, and an acoustic impedance $Z_1$ about from $1.5\times10^5$ g/cm$^2$·s, the silicone rubber should be mixed with suitable particles.

Silicone materials of small acoustic attenuation can be produced by selecting the material, shape, and conditions of particles to be mixed. The general tendency is that the acoustic attenuation $\alpha$ of a silicone material with mixed particles is caused by the viscosity between the particles and the medium, increases in proportion to the square of the diameter of the mixed particles, and also in proportion to the ratio of mixture of the particles and the density of the mixed particles. The shape of the mixed particles is preferably spherical. Minute particles of aerosil have an average diameter in the range of from 0.007 to 0.05 μm and are of spherical shape of non-porosity, properties best for use in adjustment of characteristics of acoustic lenses. Materials for such particles include $SiO_2$, $Al_2O_3$, and $TiO_2$, which have true specific gravities of 2.2, 3.3 and 4 (g/cm$^3$), respectively. The particles are mixed in 30 to 65 wt %, a mixture ratio that achieves a desired acoustic impedance $Z_1$ ranging from 1.25 to $1.50\times10^5$ (g/cm$^2$·s) necessary for acoustic lenses. The acoustic attenuation tends to increase as it is difficult to remove air bubbles sufficiently. Particles prepared by dry-type pulverization processes are generally sharp in shape, have a diameter of up to 1 μm, and hence cannot be used for adjusting the characteristics of acoustic lenses. Particles of $TiO_2$ prepared by wet-type pulverization processes are of a diameter ranging from 0.08 to 1.1 μm.

FIG. 4 shows the relationship between the particle diameter and acoustic attenuation of a silicone rubber mixed with 50 wt % of particles of $TiO_2$, with an acoustic impedance $Z_1$ being a parameter in the range of from 1.25 to $1.60\times10^5$ g/cm$^2$·s in which multiple reflections due to the difference between acoustic impedances of a human body and an acoustic lens are avoided on an image displayed by a trapezoidal scanning ultrasonographic apparatus. The acoustic attenuation $\alpha$ is minimum when the particle radius is about 0.1 μm in any of the acoustic impedances. Where the necessary acoustic attenuation level is 1.4 dB/mm or less, the particle diameter has a larger limit of 0.2 μm. With particles having a diameter of 0.08 μm or smaller, the acoustic attenuation increases discontinuously. It follows from the above that the diameter of particles for use in acoustic lenses should preferably in the range of from 0.08 to 0.20 μm. Points ⊙ in FIG. 6 indicate a diameter of 0.03 μm with $Z_1=1.1\times10^5$ (g/cm$^2$·s) at a mixture limit. In such points, due to difficulty in removing air, the acoustic attenuation $\alpha$ becomes considerably greater than 1 dB/mm. In any case, the particle diameter should be in the range of from 0.08 to 0.20 μm, with 0.1 μm being minimum, for reducing the acoustic attenuation $\alpha$, a limitation in which the particles are available inexpensively for reducing desired acoustic lenses to practice.

Figure 7:
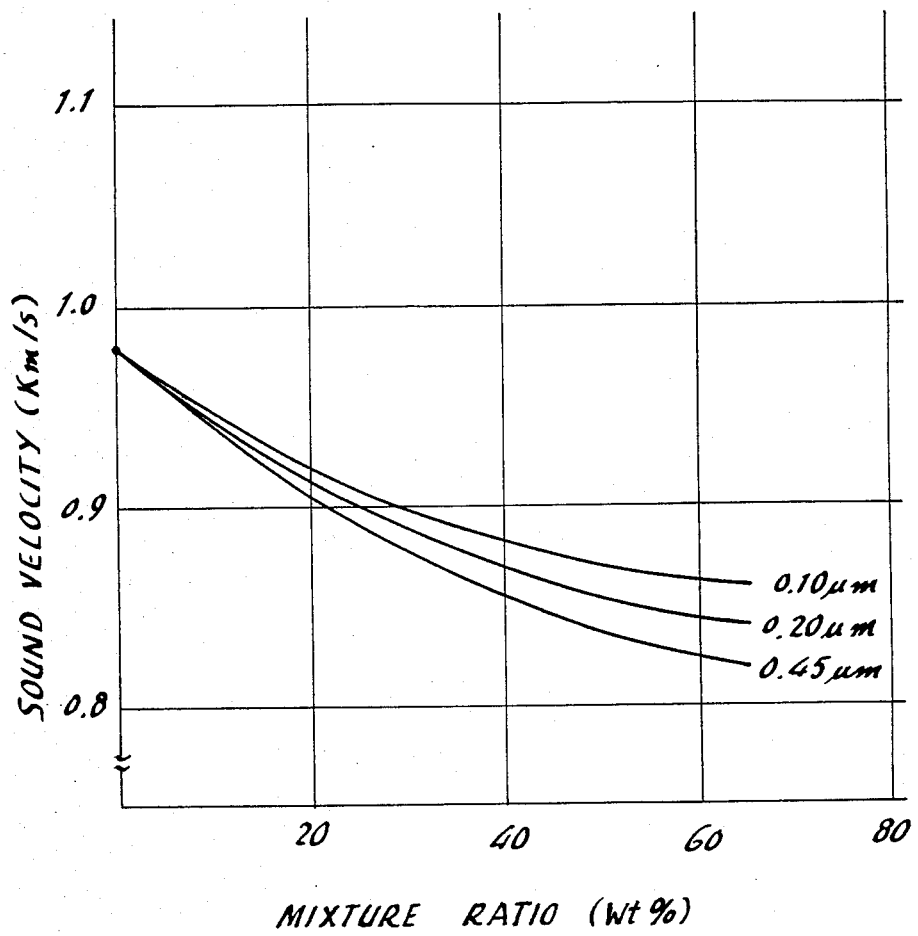
FIG. 7 is a graph showing the relationship between the amount of particles mixed with silicone rubber and sound velocity.
Figure 8:
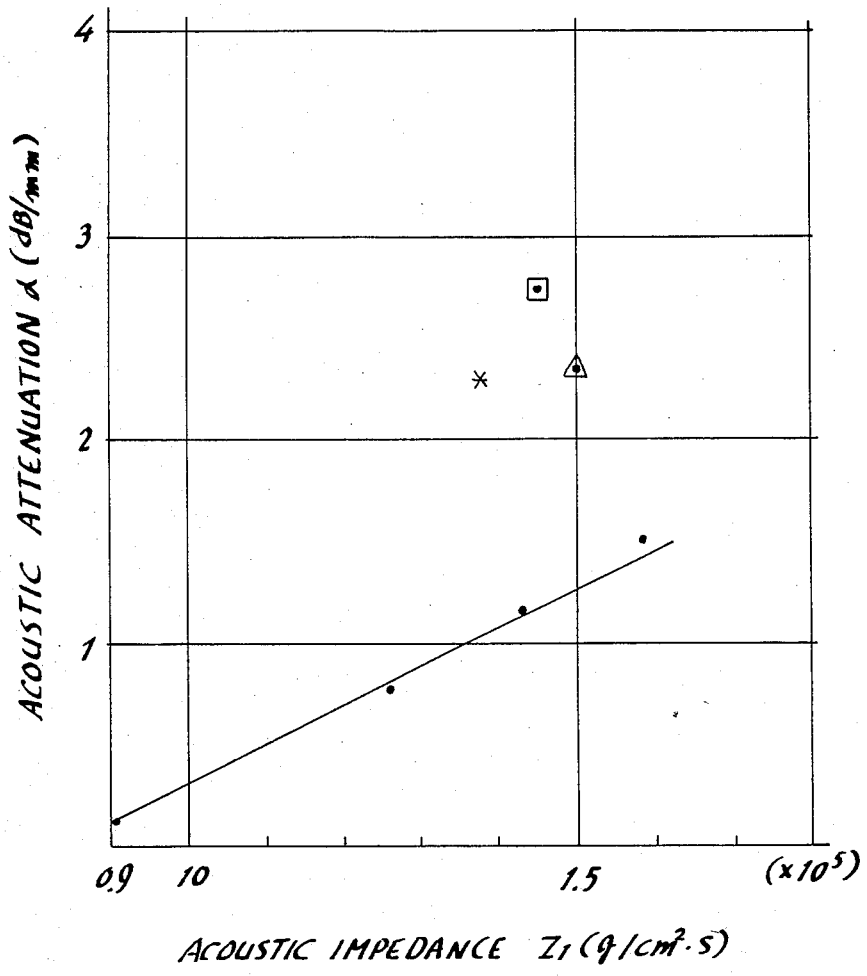
FIG. 8 is a graph illustrative of characteristics of an acoustic lens material.

FIG. 7 shows the sound velocity as it varies with the mixture weight ratio of particles with a mixed particle diameter being a parameter. The sound velocity is 885 m/s at 40 wt % and 860 m/s at 60 wt %, resulting in a sound velocity reduction of 10 to 15%. This allows an acoustic path in the lens material to be reduced. Therefore, the above property is preferable for an acoustic lens material. The greater the particle diameter, the lower the sound velocity, a characteristic which is effective in reducing the acoustic path. However, since the acoustic attenuation is also increased, the reduction of the sound velocity has a limit of 860 m/s. The difference between ultrasonic wave path lengths is 5 mm. Where the attenuation difference between the ends and the center of the lens is reduced by 10 dB through drive voltage compensation, the acoustic lens causes an attenuation of about 1.0 dB/mm or below. With the attenuation difference reduced by 15 dB through drive voltage compensation, the acoustic lens causes an attenuation of about 1.5 dB/mm or below. Taking a practical sound velocity of 900 m/s or below into account, the mixture ratio should preferably be 30 wt % or greater, and taking the sound velocity reduction limit of 860 m/s into consideration, the mixture ratio of 65 wt % is preferred. Silicone rubbers available on the market and those for use in acoustic lenses now in use have a sound velocity therethrough in the range from 950 to 1,130 m/s. Accordingly, an acoustic lens material of a silicone rubber mixed with particles is improved as to sound velocity.

Figure 6:
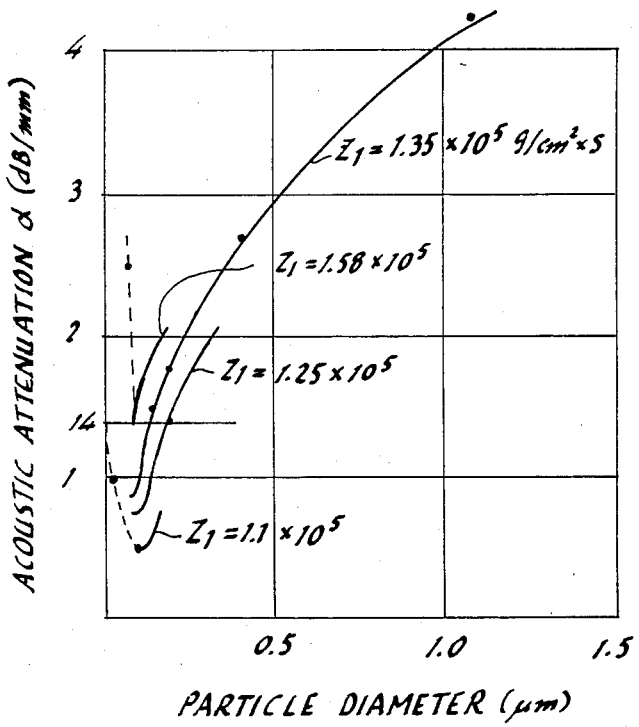
FIG. 6 is a graph showing the relationship between the diameter of particles mixed with silicone rubber and acoustic attenuation.

FIG. 6 shows the relationship between the acoustic impedance $Z_1$ and the acoustic attenuation as plotted when particles of a diameter of 0.1 m are mixed in silicone rubber. A straight line drawn across markings indicate an acoustic lens material according to the present invention, while markings ⊡, △, * show commercially available materials. The graph of FIG. 6 shows that the acoustic lens material of the invention has an acoustic attenuation that is about 1 dB/mm smaller than that of the materials on the market. Consequently, by mixing particles of $TiO_2$ having a diameter in the vicinity of 0.1 m into silicone rubber, an acoustic lens material can be obtained which has a relatively small sound velocity of 860 m/s and an acoustic attenuation that is little over 1 dB/mm smaller than that of known materials. As a result, there is provided for practical use an acoustic lens having an acoustic path of a few mm or longer and different acoustic path lengths for use in trapezoidal scanning ultrasonographic probes. The material of the present invention can also be used as general acoustic mediums.

It is preferred that acoustic lenses for use in ultrasonographic probes be clean for medical purposes as they are exposed for contact with human bodies. The acoustic lens is white in color and has a preferred appearance.

With the arrangement of the present invention, the acoustic lens can converge a beam of ultrasonic energy, expel air from between itself and a living body, does not disturbe ultrasonic waves in the living body, and causes as small attenuation as possible.

Although a certain preferred embodiment of the present invention has been shown and described in detail, it should be understood that various changes and modifications may be made therein without departing from the scope of the appended claims.

What is claimed is:

1. An acoustic lens made of a material consisting essentially of silicone rubber and titanium oxide particles having a diameter ranging from 0.08 to 0.20 μm and mixed in the silicone rubber.

2. An acoustic lens according to claim 1, wherein said particles are mixed at a ratio ranging from 30 wt % to 65 wt % in the silicone rubber.

3. An acoustic lens according to claim 1, wherein said material is molded into a shape having one rectangular end face and an opposite end face concavely shaped along a longitudinal direction of said one rectangular end face, including an array of ultrasonic transducer elements disposed on said concavely shaped opposite end face.

* * * * *